United States Patent [19]

Orsos

[11] 4,134,222

[45] Jan. 16, 1979

[54] TICKETING SYSTEM

[76] Inventor: Nicholas M. Orsos, 70 Wilberforce Ave., Rose Bay, New South Wales 2029, Australia

[21] Appl. No.: 744,837

[22] Filed: Nov. 24, 1976

[51] Int. Cl.[2] ..... G09F 7/20

[52] U.S. Cl. ..... 40/606; 248/484

[58] Field of Search ..... 40/125 H, 10 R, 10 C, 40/10 D, 606–610; 248/479–481, 484, 291, 183, 185, 181, 278

[56] References Cited

U.S. PATENT DOCUMENTS

| | | | |
|---|---|---|---|
| 1,606,369 | 11/1926 | Johnston | 40/125 H X |
| 1,868,031 | 7/1932 | Sudbrink | 248/484 X |
| 2,504,331 | 4/1950 | Hopp et al. | 40/5 X |
| 3,428,286 | 2/1969 | Del Pesco | 248/278 X |

FOREIGN PATENT DOCUMENTS

| | | | |
|---|---|---|---|
| 503192 | 3/1929 | United Kingdom | 248/484 |

*Primary Examiner*—John F. Pitrelli
*Attorney, Agent, or Firm*—Ladas, Parry, Von Gehr, Goldsmith & Deschamps

[57] ABSTRACT

A Ticketing arrangement particularly for food products is designed to avoid penetration of such products.

The arrangement includes a ticket bearing member rotatably movable within a socket which is connectable to a support which in turn can be affixed to the food products without sticking into such products.

6 Claims, 3 Drawing Figures

TICKETING SYSTEM

Figure 1:
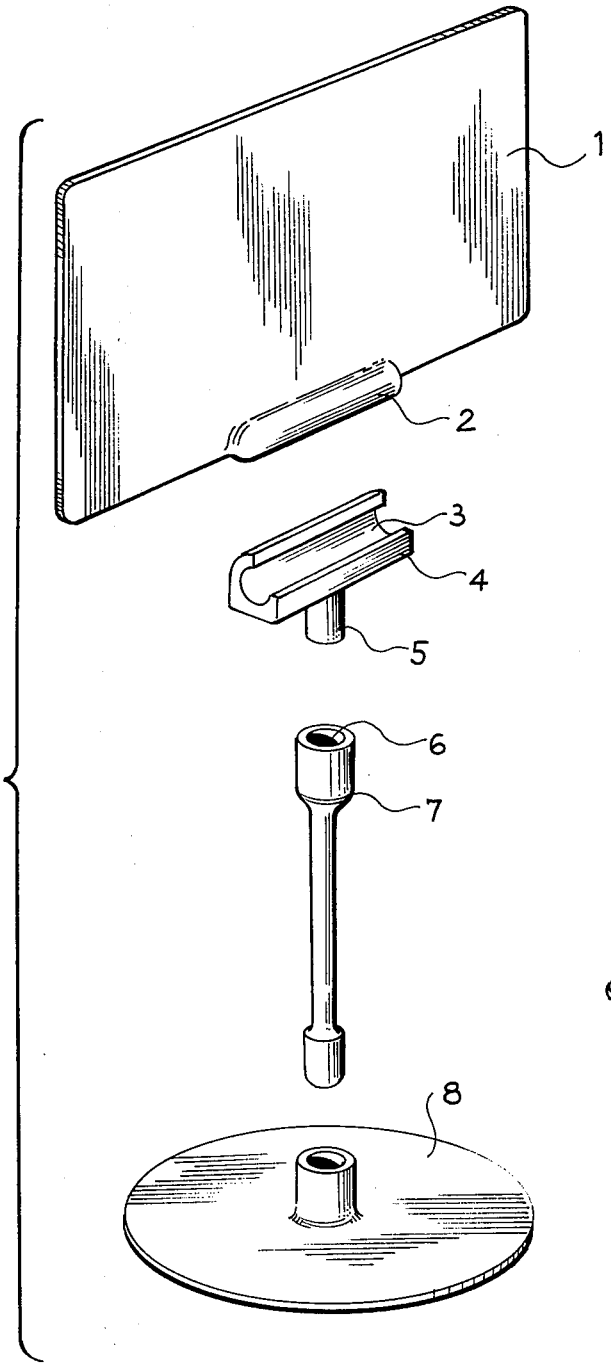

This invention relates to a ticketing system, particularly a system adapted for use on foodstuffs.

It has hitherto been a common practice for tickets to be applied to foodstuffs by means of a spike device having a price bearing ticket etc. at one end, the other end being driven into the foodstuff in question, for example fruit, vegetables, meat, sausages and the like.

Such practice carries the risk of contaminating the foodstuffs in question and already certain health authorities have introduced legislation banning the use of stick-in devices of this type.

It is an object of the present invention to provide a ticketing arrangement which avoids the risks of contamination inherent in the stick-in type of system.

According to the present invention a ticketing arrangement comprises a substantially spherical or cylindrical ticket-bearing member adapted to fit closely within a socket member and to move rotatably therein, the socket member being adapted for connection to suitable supporting means.

It is customary to display many foodstuffs, for example fruit, vegetables, meat and the like, on trays and, as already mentioned, to indicate the price or other information by means of stick-in pins to which appropriate tickets are attached. Frequently such trays are tilted at an angle in order to display the stock to best advantage and this fact has not hitherto in any way affected the ticketing of the goods in question. With the restrictions increasingly being introduced on the use of stick-in labels however, the use of tilted trays becomes a problem in that it is difficult to use conventional ticketing arrangements unless these are actually stuck into the goods themselves.

The arrangement of the present invention permits the angle of the ticket relative to its support to be adjusted by rotation of the ticket bearing member within the socket member to render the information fully visible.

Ticketing arrangements according to the invention may be affixed either to the goods in a non-stick-in fashion, for example by means of a stand arrangement which may be buried in the goods in question, affixed to a tray or other goods-storing means, or affixed to the goods themselves.

The ticket bearing member may conveniently be provided with a slot adapted to receive a ticket on which information may be recorded although any other appropriate means of affixing a ticket to such member may be employed. Alternatively, the ticket may be integrally formed with the cylindrical member.

The socket member may be secured to the supporting means in any suitable manner. Thus, it may be integrally formed with the supporting means, screwed into such supporting means, push-fitted or in any other fashion.

The base of the supporting means may be adapted to the required mode of use. For example, the base may comprise a foot adapted to rest on a flat surface, or alternatively adapted for attachment to another member such as a tray, or may be a clip device adapted to fit around goods of appropriate shape. The base may be formed either integrally with or separately from the remainder of the support.

Ticketing devices according to the present invention may be made of any suitable material but synthetic plastics materials are particularly convenient.

Figure 2:
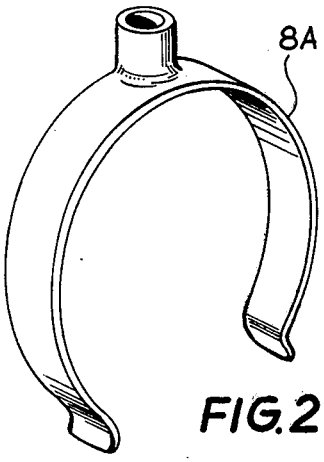
Figure 3:
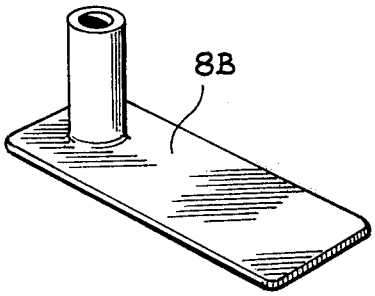

The invention is illustrated with particular reference to the accompanying drawings in which FIG. 1 illustrates in exploded fashion one embodiment of a ticketing arrangement according to the invention, FIGS. 2 and 3 illustrate alternative base portions for such ticketing arrangement.

In FIG. 1 ticket 1 is integrally formed with a ticket holding member 2 which in use is rotatably received within the recess 3 in socket member 4. The boss fitting 5 of socket member 4 may be push-fitted into the corresponding recess 6 in support member 7 which is provided with one form of base 8 adapted for standing on a flat surface.

For example, the device illustrated in FIG. 1 when assembled may be placed in a tray of say, fruit, and the fruit accommodated around the base of such device in the usual way. If the tray is sloped in the usual manner, the ticket bearing member 2 may be rotated by pressure on ticket 1 in order to move the latter into a position in which it is visible notwithstanding the fact that the supporting member 7 would not be vertical. The rotation of cylindrical member 2 and ticket 1 can of course, be adjusted to any convenient position corresponding to the slope of the tray.

Alternative base members 8A and 8B illustrated in FIGS. 2 and 3 respectively may be substituted for base 8 illustrated in FIG. 1.

FIG. 2 illustrates a clip type base 8A which may conveniently be spring fitted around, say, a salami and the ticket again adjusted rotatably so that the information thereon is plainly visible.

Base 8B illustrated in FIG. 3 is adapted for wedging under an actual container, for example a tray, such as might be used for displaying meat and again the ticket may be adjusted.

The present invention affords a simple, adaptable and hygienic system for ticketing goods displayed for sale, and particularly foodstuffs which hitherto have been ticketed by means of stick-in ticket devices.

I claim:

1. A ticketing arrangement for carrying price information pertaining to foodstuffs comprising support means formed with a first cylindrical recess, a socket member defining a second cylindrical recess and formed with a cylindrical boss for insertion into said first cylindrical recess whereby said socket member may move rotatably therein and has its central axis extending substantially perpendicular to the central axis of said second cylindrical recess, and a ticket which is formed in one piece with a cylindrical portion along one edge thereof for mating insertion within said second cylindrical recess whereby said ticket may rotate about said central axis of said second cylindrical recess for selective variation of the orientation of said ticket.

2. A ticketing arrangement according to claim 1, wherein the support means comprise an elongate member having said first cylindrical recess formed at one end thereof and formed with a second cylindrical boss at the other end thereof, and wherein the ticketing arrangement further comprises a base member formed with a cylindrical socket adapted to receive said second cylindrical boss.

3. A ticketing arrangement according to claim 10, wherein the support means have a base portion which is adapted to be buried in goods to be displayed and to be retained in position by the weight and disposition of such goods.

4. A ticketing arrangement according to claim 1, wherein the support means have a base portion which is adapted to be fixed to goods to be displayed.

5. A ticketing arrangement according to claim 1, wherein the support means have a base portion which is adapted to be fixed to a display container for goods to be displayed.

6. A ticketing arrangement according to claim 1, wherein the ticket is substantially rectangular.

* * * * *